US009581951B2

(12) United States Patent
Ono

(10) Patent No.: US 9,581,951 B2
(45) Date of Patent: Feb. 28, 2017

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Shinji Ono, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/805,070

(22) Filed: Jul. 21, 2015

(65) Prior Publication Data

US 2016/0070219 A1 Mar. 10, 2016

(30) Foreign Application Priority Data

Sep. 5, 2014 (JP) ..... 2014-180976

(51) Int. Cl.
*G03G 15/00* (2006.01)

(52) U.S. Cl.
CPC ..... *G03G 15/607* (2013.01); *G03G 15/50* (2013.01); *G03G 15/5025* (2013.01)

(58) Field of Classification Search
CPC .. G03G 15/50; G03G 15/5059; G03G 15/607; G03G 15/5025
See application file for complete search history.

(56) References Cited

U.S. PATENT DOCUMENTS 5,946,527 A * 8/1999 Salgado ..... B65H 1/04 271/3.01
7,161,714 B1 * 1/2007 Namizuka ..... H04N 1/3935 358/1.2
2005/0095045 A1 * 5/2005 Suzuki ..... G03G 15/607 399/376
2006/0285139 A1 * 12/2006 Baunach ..... H04N 1/00779 358/1.12
2009/0009820 A1 * 1/2009 Fukui ..... H04N 1/3875 358/449

FOREIGN PATENT DOCUMENTS

JP 2003241575 A * 8/2003
JP 2010141508 A 6/2010

OTHER PUBLICATIONS

English translation to JP 2003241575 A, Kawachi, Published Aug. 2003.*

* cited by examiner

*Primary Examiner* — Ryan Walsh
(74) *Attorney, Agent, or Firm* — Patterson & Sheridan, LLP

(57) ABSTRACT

According to an embodiment, an image forming apparatus includes a scanner, a printer, and a controller. The controller estimates a maximum size of a document sheet scanned by the scanner. Further, the controller controls the scanner to reduce a document image at a predetermined reduction magnification ratio when the estimated maximum size of if larger than a predetermined size of a printing sheet.

12 Claims, 6 Drawing Sheets

IMAGE FORMING APPARATUS

CROSS-REFERENCE TO RELATED APPLICATION

This application is based upon and claims the benefit of priority from the prior Japanese Patent Application No. 2014-180976, filed on Sep. 5, 2014, the entire contents of which are incorporated herein by reference.

FIELD

Embodiments described herein relate generally to an image forming apparatus having an automatic magnification function capable of printing on printing sheets with the same size even when a size of document sheets cannot be detected when a plurality of document sheets with different sizes are mixed and set in a document tray of an automatic document feeder.

BACKGROUND

Conventionally, reading of document images of the document sheets may be started in a document mixed loading state where document sheets with different sizes are set in a document tray of an automatic document feeder. In such a document mixed loading state, the document image is read at a magnification ratio according to the size of the printing sheets when the sizes of the document sheets can be detected before the reading of the document images is started. Accordingly, the read document image data is output as it is to a printer, and it is possible to print all the document images on the printing sheets with the same size.

However, when the automatic document feeder is configured to detect the length of a large-size document sheet in a transport direction from the document tray to a document reading position, the automatic document feeder becomes large.

For example, a scan processing unit of an image forming apparatus first stores the read image data of all the document sheets in a storage medium such as a memory in a state where a magnification process is not performed thereon. After the size of each document sheet is detected in the automatic document feeder, the scan processing unit determines a magnification ratio for performing the magnification process on the reading image data according to the printing sheets. Accordingly, in order to print all the document images on the printing sheets with the same size, there is proposed a method in which the scan processing unit performs the magnification process on the stored reading image data at the determined magnification ratio. Alternatively, there is proposed a method in which a print processing unit has a reduction function and an enlargement function, and the print processing unit performs the magnification process on the stored reading image data. However, in such methods, memory capacity is increased, and a print speed is decreased. For example, the image forming apparatus performs the magnification process from the document image data with A3 size into image data with A4 size using the reduction function of the print processing unit, and prints the magnification-processed document image data on the printing sheet with A4 size transported at a normal transport speed. Herein, the normal transport speed is, for example, a transport speed of the printing sheet with A4 size in a case where a document image (document image data with A4 size) of a document sheet with A4 size on a printing sheet with A4 size. In a case of the printing, since the length of the document with A3 size in the transport direction is double the printing sheet with A4 size, the first half of the document image data is printed, but the second half is not printed. Accordingly, the image forming apparatus lowers a transport speed of the printing sheet, for example, to a half speed of the normal transport speed, thereby printing all the document images of the document sheets with A3 size in a reduction state.

DETAILED DESCRIPTION

Figure 1:
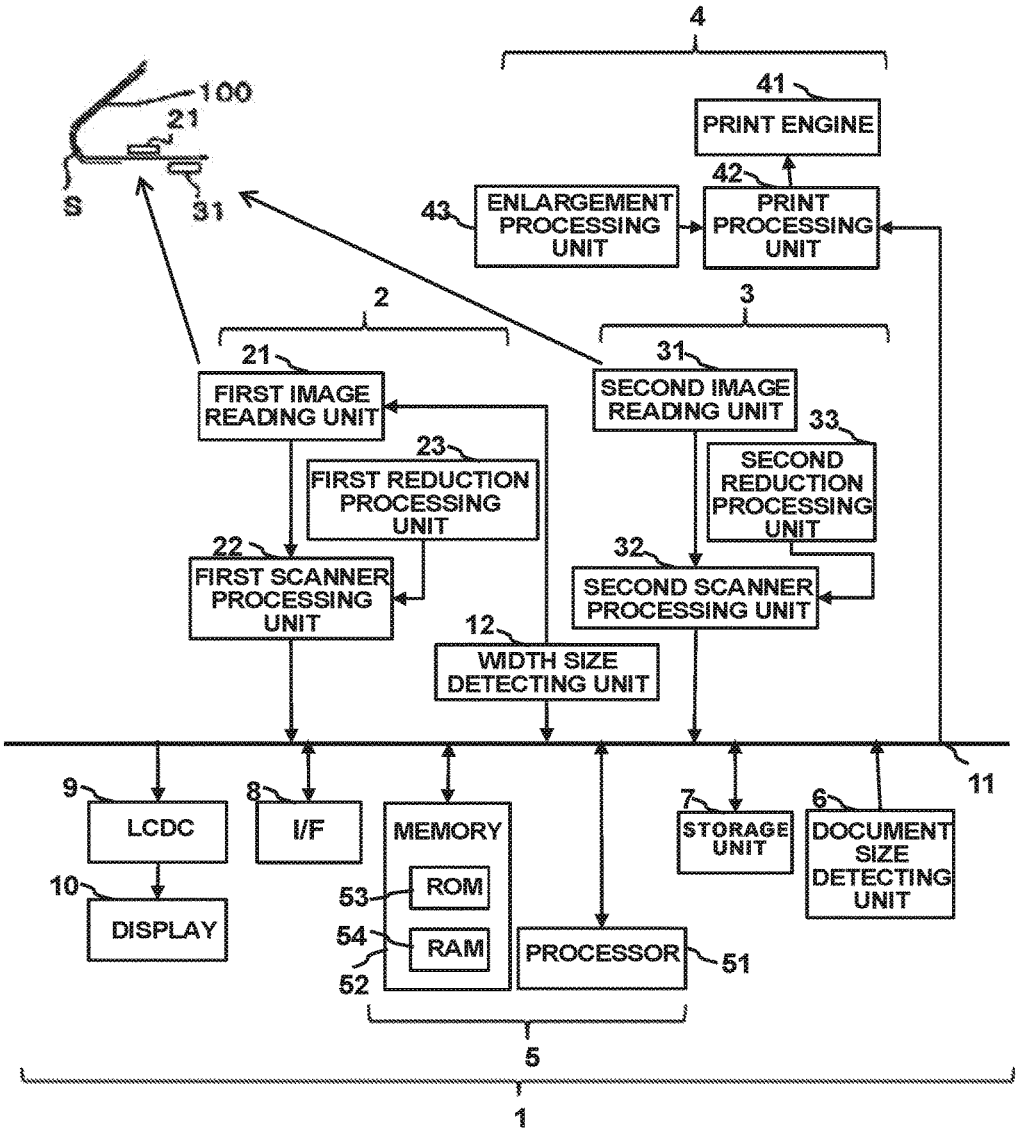
FIG. 1 is a block diagram illustrating a control configuration of an image forming apparatus according to a first embodiment.

According to an embodiment, an image forming apparatus includes a scanner, a printer, and a controller. The scanner scans a plurality of document sheets with different sizes, reduces document images of the document sheets, and outputs the processed document images. The printer equal-magnification-processes or enlarges the document images, and prints the images on printing sheets with a predetermined size. The controller estimates a maximum size of the document sheets scanned by the scanner. Moreover, the controller controls the scanner to reduce the document image at a predetermined magnification ratio when the estimated maximum size is larger than the predetermined size of the printing sheets.

Hereinafter, embodiments will be further described with reference to the drawings. In the drawings, the same reference symbols denote the same or similar parts.

A control configuration of the image forming apparatus according to a first embodiment will be described with reference to FIG. 1. A reduction copy method in the image forming apparatus will be described with reference to FIGS. 2A and 2B. An enlargement copy method in the image forming apparatus will be described with reference to FIG. 3. A scan operation in the copy operation of the image forming apparatus will be described with reference to FIG. 4. A printing operation in the copy operation of the image forming apparatus will be described with reference to FIG. 5. First, the reduction copy method in the image forming apparatus according to the first embodiment will be described with reference to FIGS. 2A and 2B. FIGS. 2A and 2B are diagrams for describing the reduction copy method in the image forming apparatus. The reduction copy described herein means that a document image is copied on a printing sheet with a size equal to or smaller than a document sheet size.

FIG. 2A is a diagram for describing a method of printing a document image by reducing the document image at the time of the scan operation in the reduction copy operation. Specifically, in a document tray of an automatic document feeder (hereinafter, referred to as ADF), document sheets with A3 size and document sheets with A4 size are set in a so-called document mixed loading state. The document image of the document sheet is printed on the printing sheet with A4 size. The document tray of the ADF includes a document guide member (not illustrated) that regulates a width-direction position of the document sheets set by a user. In order to regulate the width-direction position of the document sheet, the document guide member is disposed in the document tray of the ADF variably depending on the width-direction length of the document sheets. The width direction of the document sheets is a direction orthogonal to the transport direction of the document sheets set in the document tray. The size of the document sheets which can be set in the document tray is A3 size or less. The document sheets with A3 size can be set only when the longitudinal direction thereof is the transport direction. Accordingly, the width-direction length of the document sheets with A3 size is a short-direction length of the document sheets with A3 size. Meanwhile, the longitudinal-direction length of the document sheets with A4 size is the same as the short-direction length of the document sheets with A3 size. Accordingly, when the document sheets with A4 size are set in the document tray such that the longitudinal direction of the document sheets with A4 size is the transport direction, and when the document sheets with A3 size are set in the document tray, the positions of the document guide member become the same position P. In addition, even when the document sheets with A4 size and the document sheets with A3 size are mixed and set in the document tray, the position of the document guide member becomes the position P. Accordingly, by the position of the document guide member, it is possible to detect the width-direction length of the document sheets set in the document tray, and by the detection result, it is possible to estimate a maximum size of the document sheets set in the document tray. For example, when the position of the document guide member is the position P, it is estimated that the maximum size of the document sheets set in the document tray is A3 size.

In FIG. 2A, as described above, since it is estimated that the maximum size of the document sheet is A3 size, the document sheet is scanned as A3 size. As described above, since the size of the printing sheet is A4 size, the document image scanned as A3 size is reduced and copied on the printing sheet with A4 size. Specifically, the image forming apparatus acquires a reduction magnification ratio in the scan operation from the relation between the maximum size of the estimated document sheet and the size of the printing sheet. For example, the reduction magnification ratio is acquired as a reduction magnification ratio X% necessary for the reduction process from A3 size (the maximum size of the document sheet) to A4 size (the size of the printing sheet).

Accordingly, when the document sheet is A3 size, the document sheet is scanned at the reduction magnification ratio X% at the time of the scan operation. The document image data read by the scan is reduced from A3 size to A4 size, and is stored in the storage unit. In other words, the document image data with A4 size is stored in the storage unit. Accordingly, the capacity of the storage unit may be small. In addition, at the time of the printing operation, the reduced document image data (the document image data with A4 size) is used as it is (the equal magnification process), and it is possible to print the document image on the printing sheet with A4 size. Furthermore, even when the image forming apparatus cannot acquire size information of the document sheet whether the size of the document sheet is the A3 size or the A4 size before starting the scan operation, it is possible to acquire the size information when the scan operation ends.

Meanwhile, even when the size of the document sheet is the A4 size, the document sheet is scanned at the reduction magnification ratio X% at the time of the scan operation. In other words, even when the size of the document sheet is the A4 size, is scanned as the document sheet with A3 size. Accordingly, the scan is performed including an area indicated by oblique lines of FIG. 2A. Moreover, the document image data read by the scan operation is reduced to a size smaller than A4 size by the reduction magnification ratio X%, and is stored in the storage unit.

Accordingly, at the time of the printing operation, the reduced document image data is enlarged at a predetermined enlargement magnification ratio to be restored to the original A4 size, and the document image is printed on the printing sheet with A4 size. Since the reduction magnification ratio X% is the reduction magnification ratio from A3 size to A4 size, the predetermined enlargement magnification ratio is acquired as an enlargement magnification ratio Y (1/X)% from A4 size to A3 size.

However, as described above, the image forming apparatus cannot detect whether the size of the document sheet is A4 size at a start time point of the scan operation. Accordingly, as described above, regardless of the size of the document sheet, the image forming apparatus reduces the document image at the predetermined reduction magnification ratio X%. The image forming apparatus can determine the size of the document sheet when the scan operation ends. The image forming apparatus equal-magnification-processes (non-magnification process) or enlarges (at the enlargement magnification ratio Y%) the document image according to the determined size of the document sheet at the time of the printing operation after the scan operation.

The document image of the document sheet with A4 size is reduced at the time of the scan operation as described above, and is enlarged to the original A4 size at the time of the printing operation. When the reduced document image data is enlarged at the time of the printing operation, simply, the enlarged data amount is a half with respect to the printing sheet with A4 size. For this reason, the image forming apparatus can print the document image with sufficient time even when the transport speed of the printing sheet with A4 size is not lowered.

In the reduction copy method described above, FIG. 2B is a diagram for describing a method of printing the document image in which a reduction process is not performed at the scan operation, instead, the document image data is reduced at the time of the printing operation in the reduction copy operation. When raw document image data of the document sheet with A3 size is printed on the printing sheet with A4 size, in other words, when the document image with A3 size is not reduced at the time of the scan operation and is reduced at the time of the printing operation as the printing sheet with A4 size, when a printing speed (a transport speed of the printing sheet) is a printing speed for the printing sheet with A4 size, only a half (printable image data) of the document image data with A3 size is printed, and the other half (unprintable image data) is not printed as illustrated in FIG. 2B. Then, the image forming apparatus prints all the document image data with A3 size by lowering the printing speed. However, when the printing speed is lowered, the number of printing sheets processed is remarkably decreased. For this reason, it is not realistic that the document image is printed while reducing the document image at the time of the printing operation.

Figure 3:
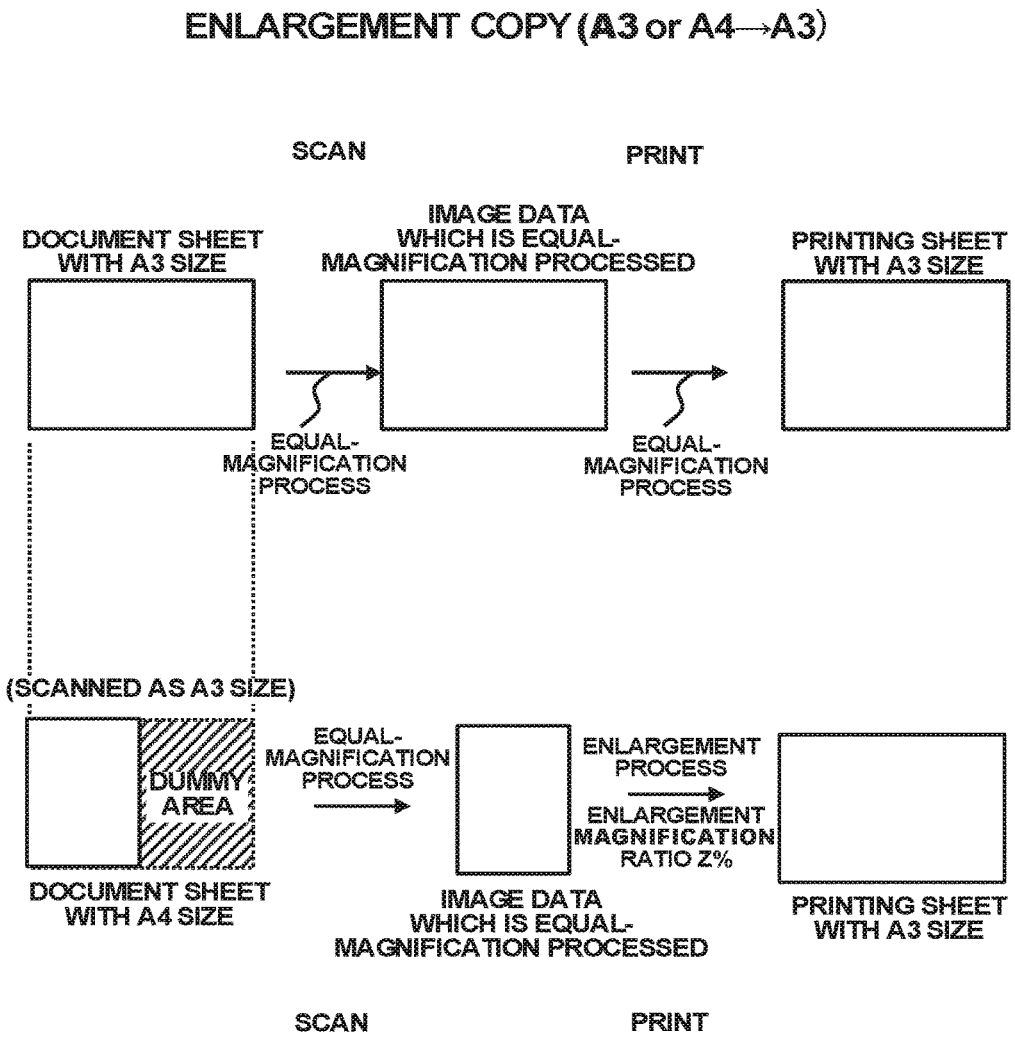
FIG. 3 is a diagram for describing an enlargement copy operation of the image forming apparatus according to the first embodiment.

Hereinafter, the enlargement copy method in the image forming apparatus according to the first embodiment will be described with reference to FIG. 3. FIG. 3 is a diagram for describing the enlargement copy method in the image forming apparatus. The enlargement copy described herein means that the document image is copied on the printing sheet with a size equal to or larger than the document sheet size. As illustrated in FIG. 3, for example, when the document image of the document sheet with A3 size is copied on the printing sheet with A3 size, the document image is printed on the printing sheet with the same size as the document sheet size. For this reason, the document image is not reduced at the time of the scan operation and the printing operation. The document image is equal-magnification-processed (non-magnification process) at the time of the scan operation, and the document image is equal-magnification-processed also at the time of the printing operation. Meanwhile, when the document image of the document sheet with A4 size is copied onto the printing sheet with A3 size, the document image is printed on the printing sheet with a size larger than the document sheet size. For this reason, the document image is equal-magnification-processed at the time of the scan operation, and the document image is enlarged (or equal-magnification-processed) at the time of the printing operation. As illustrated in FIG. 3, the document image of the document sheet with A4 size is scanned to an area of the document sheet with A3 size. An area outside the area of the document sheet with A4 size is a dummy area, and is not stored in the memory. At the time of the printing operation, the document image data with A4 size is printed on the printing sheet with A3 size having a printing area as twice large as the A4 size, and thus the image forming apparatus can perform printing with sufficient time.

That is, when the document image is copied in the document mixed loading state where the document sheets with different sizes are set in the document tray of the ADF, the image forming apparatus estimates the maximum size of the document sheet from the width-direction length of the document sheets set in the document tray of the ADF. The image forming apparatus acquires the relation between the estimated maximum size of the document sheet and the printing sheet size. In a case where the image forming apparatus determines that it is necessary to reduce the document image (the document image with A3 size) with the maximum size based on the acquired result, the image forming apparatus performs reducing and scanning using the maximum reduction magnification ratio in the scan operation on all the document sheets. The maximum reduction magnification ratio is a reduction ratio necessary for the reduction process from the estimated maximum size of the document sheet to the printing sheet size (for example, A4 size). The image forming apparatus enlarges and prints the reduced image in the printing operation. In addition, in a case where the image forming apparatus determines that it is necessary to enlarge the document image based on the acquired result, the image forming apparatus does not perform the magnification process and performs the scanning in the scan operation for all the document sheets. The image forming apparatus enlarges and prints the document image necessary to be enlarged in the printing operation.

Hereinafter, a system configuration of the image forming apparatus according to the first embodiment will be described with reference to FIG. 1. The image forming apparatus according to the first embodiment is, for example, a multifunction printer (hereinafter, referred to as MFP) which can simultaneously read both side.

Figure 2A:
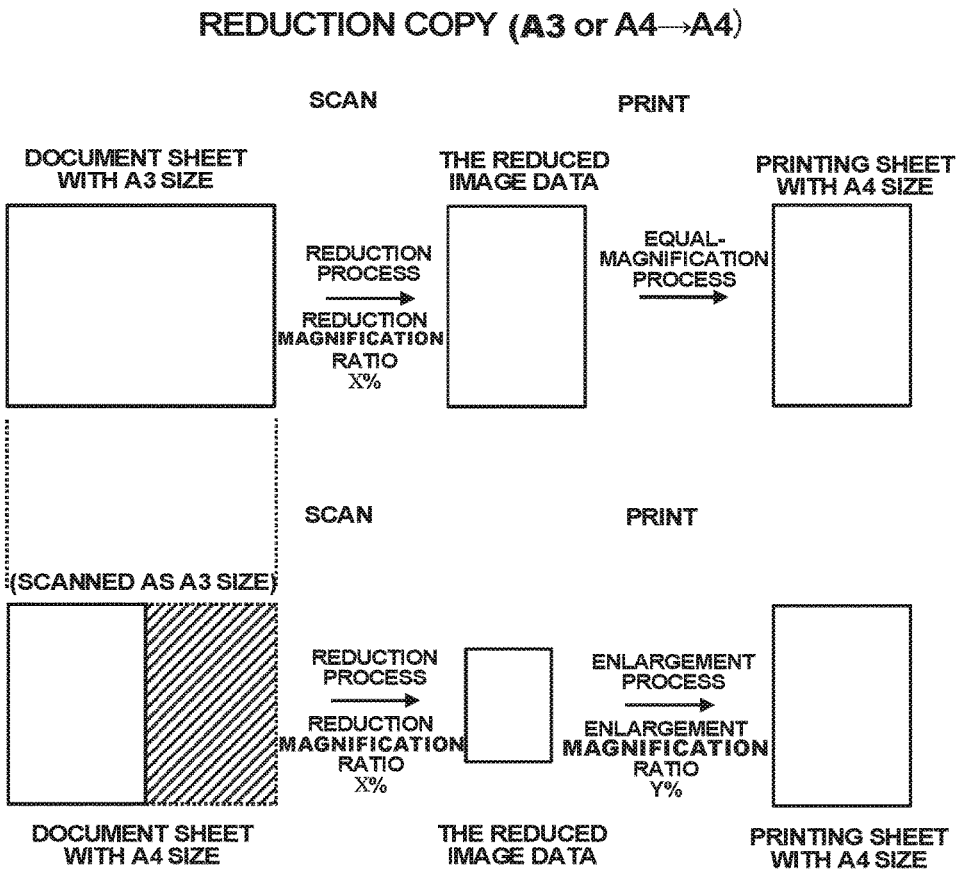
FIG. 2A is a diagram for describing a method of reducing a document image at the time of a scan operation in a reduction copy operation of the image forming apparatus according to the first embodiment.
Figure 2B:
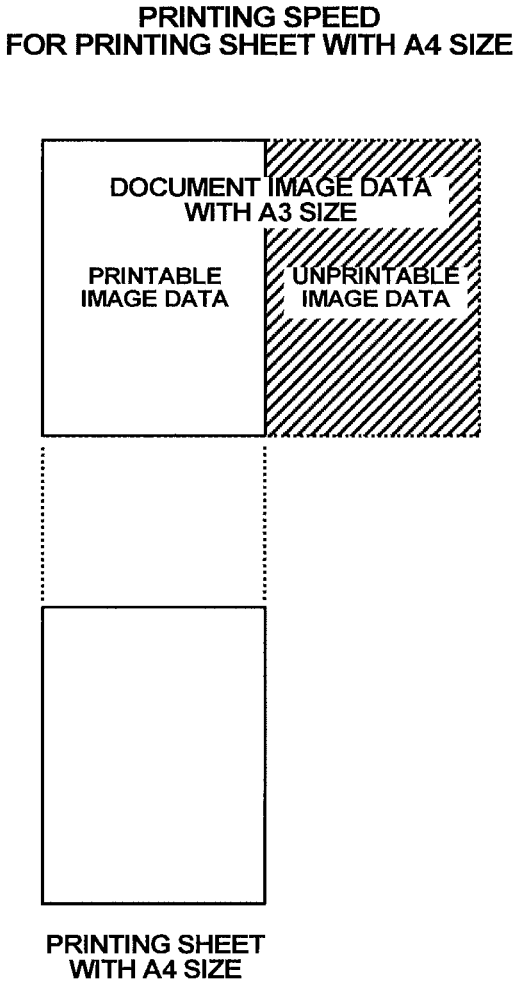
FIG. 2B is a diagram for describing a method of reducing a document image at the time of a printing operation in the reduction copy operation of the image forming apparatus.

As illustrated in FIG. 1, the MFP 1 includes a first scanner 2, a second scanner 3, a printer 4, a controller 5, a document size detecting unit 6, a storage unit 7, a communication interface (hereinafter, referred to as I/F) 8, a liquid crystal display controller (hereinafter, referred to as LCDC) 9, a display 10, and a width size detecting unit 12. In the MFP 1, the constituent units 2 to 10 and 12 are connected to an internal bus 11. The first scanner 2 includes a first image reading unit 21, a first scanner processing unit 22, and a first reduction processing unit 23. The second scanner 3 includes a second image reading unit 31, a second scanner processing unit 32, and a second reduction processing unit 33. The printer 4 includes a print engine 41, a print processing unit 42, and an enlargement processing unit 43. The controller 5 includes a processor 51 and a memory 52. The memory 52 includes a ROM 53 and a RAM 54.

The MFP 1 includes an ADF 100. The ADF 100 automatically transports the document sheet so that images on both sides of the document sheet can be read simultaneously. In order to simultaneously read the images on both sides of the document sheet, the first image reading unit 21 of the first scanner 2 and the second image reading unit 31 of the second scanner 3 are disposed on the transport path of the document sheet of the ADF 100. The ADF 100 includes a guide member (not illustrated) that regulates a document tray (not illustrated) in which the document sheet is set, and a width-direction (a direction orthogonal to the transport direction of the document sheet) position of the document sheets set in the document tray. The width size detecting unit 12 detects the width-direction length of the document sheets set in the document tray by detecting the position of the guide member.

The first scanner 2 and the second scanner 3 have the same configuration. The image of the first side (the second side) of the document sheet S read by the first image reading unit 21 (the second image reading unit 31) is processed by the first scanner processing unit 22 (the second scanner processing unit 32). At that time, the image data processed by the first scanner processing unit (the second scanner processing unit 32) is reduced according to the reduction magnification ratio set in the first reduction processing unit 23 (the second reduction processing unit 33).

As described above, the printer 4 includes the print engine 41, the print processing unit 42, and the enlargement processing unit 43. The print processing unit 42 performs a print process of enlarging the image data at the enlargement magnification ratio set in the enlargement processing unit 43. The image data to be printed enlarged by the print processing unit 42 is output to the print engine 41.

As described above, the controller 5 includes the processor 51 and the memory 52. The processor 51 includes a CPU (Central Processing Unit) or an MPU (Micro Processing Unit). The memory 52 is, for example, a semiconductor memory, and includes the ROM (Read Only Memory) 53 and the RAM (Random Access Memory) 54 as described above. The ROM 53 stores various control programs. For example, the ROM stores programs for performing a reduction scan operation, an enlargement scan operation, and an enlargement printing operation. The RAM 54 provides a temporary work area for the processor 51.

Figure 4:
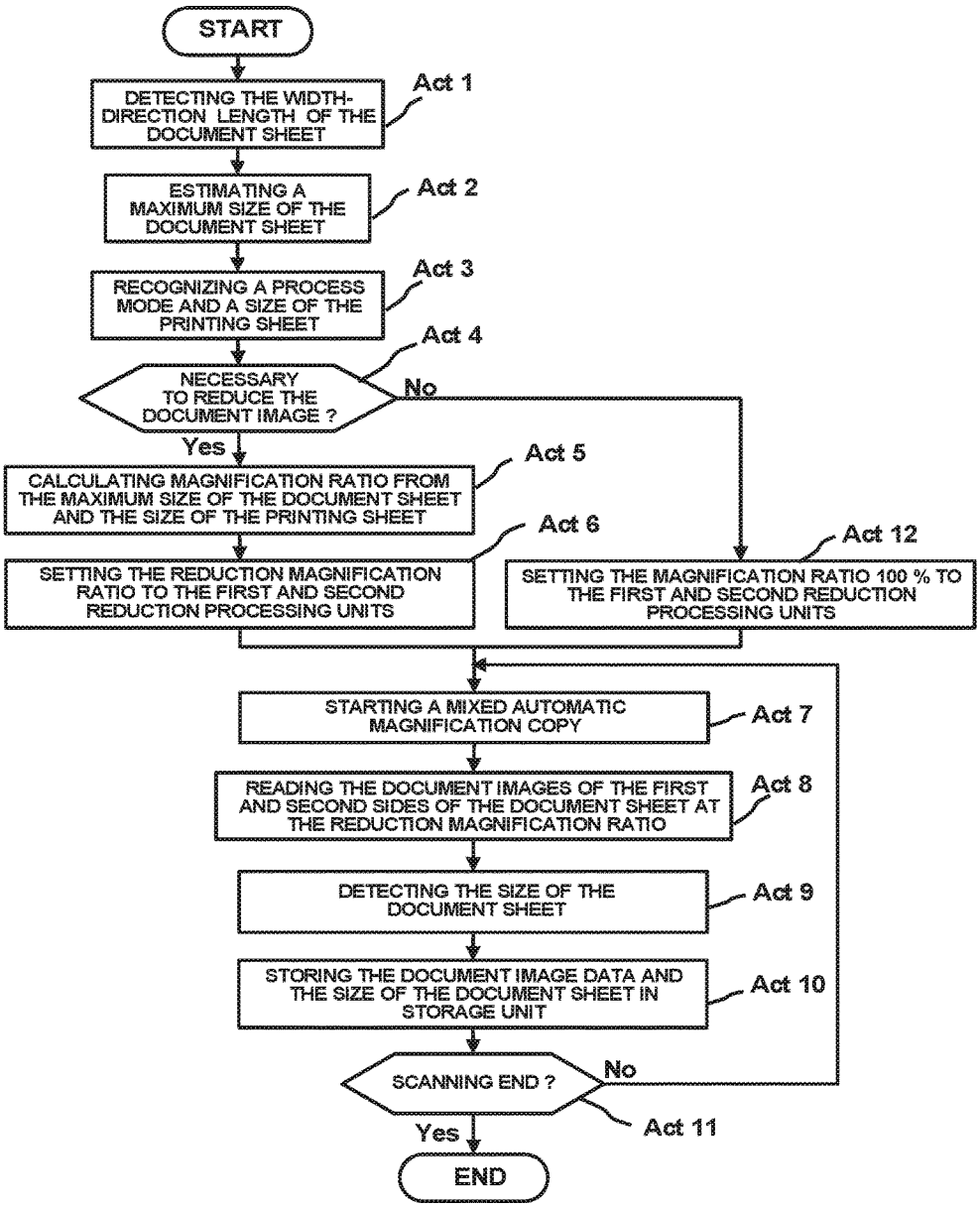
FIG. 4 is a flowchart for describing the scan operation in the image forming apparatus according to the first embodiment.
Figure 5:
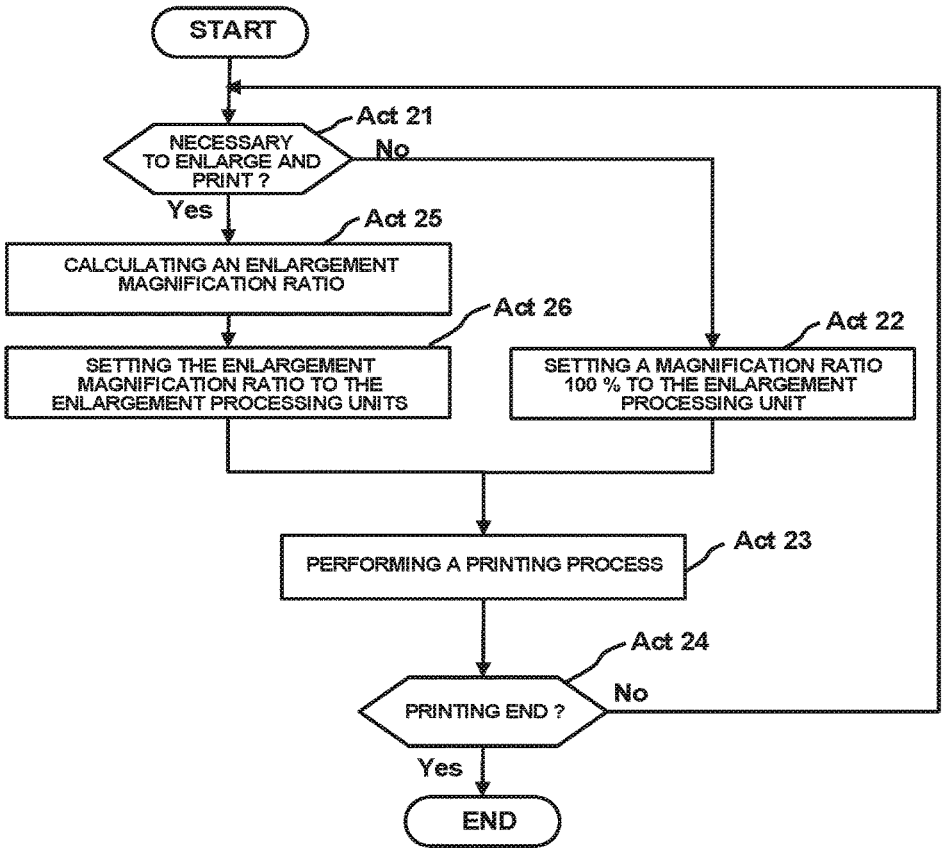
FIG. 5 is a flowchart for describing a print operation in the image forming apparatus according to first embodiment.

FIG. 4 is a flowchart for describing the scan operation. FIG. 5 is a flowchart for describing the printing operation.

The scan operation included in the copy operation of the MFP 1 will be described with reference to FIG. 4. First, the scan operation of the copy operation in a case where the size of the printing sheet is the A4 size will be described.

As illustrated in FIG. 4, in Act 1, the width size detecting unit 12 detects the width-direction length of the document sheets set in the document tray of the ADF 100.

In the document tray, the document sheets with A4 size and the document sheets with A3 size are set in advance in a mixed state by a user. The width-direction length of the document sheet is a length in a direction orthogonal to the transport direction of the document sheet. The width size detecting unit 12 informs the detected width-direction length to the processor 51. When the width-direction length of the document sheet is reported to the processor 51, the process of the MFP 1 proceeds to Act 2.

In Act 2, the processor 51 estimates a maximum size of the document sheets set in the document tray of the ADF 100 based on the width-direction length of the document sheet acquired from the width size detecting unit 12. Specifically, in the state where the document sheet is set in the document tray, the width-direction lengths of the document sheet with A4 size and the document sheet with A3 size are the same. Accordingly, the processor 51 estimates that the maximum size of the document sheets set in the document tray is the A3 size. When the processor 51 estimates the maximum size of the document sheets, the process of the MFP 1 proceeds to Act 3.

In Act 3, through the LCDC 9, the processor 51 recognizes a process mode of the MFP 1 and a size of the printing sheet which are input through an input screen of the display 10 by a user. Specifically, the processor 51 recognizes that a mixed mode is input by the user as the process mode of the MFP 1 and that A4 size is input as the size of the printing sheet. The mixed mode is a process mode of the MFP 1 in a case where document sheets with different sizes are set in the document tray of the ADF 100 as described above. When the processor 51 recognizes the process mode and the size of the printing sheet by the user, the process of MFP 1 proceeds to Act 4.

In Act 4, the processor 51 determines whether it is necessary to reduce the document image based on the estimation result of the maximum size of the document sheet (see Act 2 above) and the recognition result of the process mode and the size of the printing sheet (see Act 3 above). When the processor 51 determines that it is necessary to reduce the document image (Act 4: Yes), the process of the MFP 1 proceeds to Act 5. When the processor 51 determines that it is unnecessary to reduce the document image, in other words, it is necessary to perform the equal magnification process (Act 4: No), the process of the MFP 1 proceeds to Act 12. As described above, the processor 51 has already estimated that the maximum size of the document sheet is the A3 size in Act 2 above. Furthermore, the processor 51 has already recognized that the process mode is the mixed mode and the size of the printing sheet is the A4 size in Act 3 above. Accordingly, the processor 51 determines that it is necessary to reduce the document image based on such an estimation result and a recognition result.

In Act 5, the processor 51 calculates the reduction magnification ratio of the document image based on that the size of the printing sheet is the A4 size and the maximum size of the document sheets set in the document tray is the A3 size. The calculated reduction magnification ratio is a reduction magnification ratio X% for the reduction process from the A3 size to the A4 size. The processor 51 outputs the reduction magnification ratio X% to the first scanner processing unit 22 and the second scanner processing unit 32. When the reduction magnification ratio X% is output to the first scanner processing unit 22 and the second scanner processing unit 32, the process of the MFP 1 proceeds to Act 6.

In Act 6, the first scanner processing unit 22 and the second scanner processing unit 32 set the reduction magnification ratio X% to the first reduction processing unit 23 and the second reduction processing unit 33. When the reduction magnification ratio X is set to the first reduction processing unit 23 and the second reduction processing unit 33, the process of the MFP 1 proceeds to Act 7.

In Act 7, when the processor 51 receives a copy start instruction through a copy button (not illustrated) of the MFP 1, the processor 51 starts the copy operation including the scan operation in the document mixed loading state. When the processor 51 starts the scan operation, the process of the MFP 1 proceeds to Act 8.

In Act 8, the first scanner 2 and the second scanner 3 read the document image on the first side of the document sheet and the document image on the second side at the set reduction magnification ratio X% (see Act 5 and Act 6 above) according to the start of the scan operation. Accordingly, in a case where the size of the document sheet is the A3 size, the read document image is an image with A4 size. In addition, when the size of the document sheet is the A4 size, the read document image is an image smaller than the A4 size. When the document images on the first and second sides of the document sheet are read, the process of the MFP 1 proceeds to Act 9.

In Act 9, the document size detecting unit 6 detects the size of the document sheet based on the reading result of the first side of the document sheet. Since the size of the document sheet is the same between the first side and the second side, the detection of the document size based on the reading result of the second side is not performed. When the size of the document sheet is detected, the process of the MFP 1 proceeds to Act 10.

In Act 10, the processor 51 stores the read document image data on the first and second sides (see Act 8 above) and the size of the document sheet (see Act 9 above) in the storage unit 7. When the document image data and the size of the document sheet are stored in the storage unit 7, the process of the MFP 1 proceeds to Act 11.

In Act 11, the processor 51 determines whether all the documents set in the document tray of the ADF 100 are scanned. When the processor 51 determines that all the documents set in the document tray are not scanned yet, the process of the MFP 1 returns to Act 7. Accordingly, the processor 51 repeats the processes from Act 7 to Act 10 above until all the documents set in the document tray are scanned. When the processor 51 determines that all the documents set in the document tray are scanned, the scan operation of the MFP 1 ends.

Meanwhile, when the processor 51 determines that it is necessary to perform the equal magnification process on the document image (Act 4: No), in Act 12, the first scanner processing unit 22 and the second scanner processing unit 32 set the magnification ratio 100% to the first reduction processing unit 23 and the second reduction processing unit 33. When the magnification ratio 100% is set to the first reduction processing unit 23 and the second reduction processing unit 33, the process of the MFP 1 proceeds to Act 7 above.

Hereinafter, the printing operation of the copy operation in a case where the size of the printing sheet is the A4 size will be described with reference to FIG. 5.

In Act 21, the processor 51 determines whether it is necessary to enlarge and print the read document image stored in the storage unit or to print the read document image without enlarging. In other words, the processor 51 acquires the size of the printed image based on the size information (see Act 10 above) of the document sheet stored in the storage unit 7. The processor 51 determines whether it is necessary to enlarge and print the document image stored in the storage unit 7 or to print the document image without enlarging according to the acquired size. When the processor 51 determines that it is necessary to print the document image without enlarging, in other words, it is necessary to print the document image by the equal magnification process, the process of the MFP 1 proceeds to Act 22. When the processor 51 determines that it is necessary to enlarge and print the document image, the process of the MFP 1 proceeds to Act 25. In this case, as described above, the document image has been already reduced at the reduction magnification ratio X%. Accordingly, when the size of the document sheet stored in the storage unit 7 is the A3 size, the document image is reduced to an image with A4 size. Therefore, the processor determines that it is necessary to print the read document image by the equal magnification process.

In Act 22, the processor 51 outputs the magnification ratio 100% to the print processing unit 42 to perform the printing by the equal magnification process. The print processing unit 42 sets the magnification ratio 100% to the enlargement processing unit 43. When the magnification ratio 100% is set to the enlargement processing unit 43, the process of the MFP 1 proceeds to Act 23.

In Act 23, the print processing unit 42 processes the read document image data at the magnification ratio (100%) set in the enlargement processing unit 43, and performs a predetermined process according to the printing. The print processing unit 42 outputs the processed document image data to the print engine 41. The print engine 41 prints the document image on the printing sheet based on the document image data. When the print engine 41 prints the document image, the process of the MFP 1 proceeds to Act 24.

In Act 24, the processor 51 determines whether there is document image data to be printed in the storage unit 7. When the processor 51 determines that there is the document image data to be printed in the storage unit 7, the process of the MFP 1 returns to Act 21. Accordingly, the processor 51 repeats the processes from Act 21 to Act 23 described above including Act 25 and Act 26 to be described hereinafter until all the document images stored in the storage unit 7 are printed. When the processor 51 determines that there is no document image data to be printed in the storage unit 7, the printing operation of the MFP 1 ends.

Meanwhile, the read document image stored in the storage unit 7 is reduced at the reduction magnification ratio X%. Accordingly, when the size of the document sheet stored in the storage unit 7 is the A4 size, the document image is reduced to a size smaller than the A4 size. Therefore, in Act 21 above, the processor 51 determines that it is necessary to enlarge and print the document image in order to return to the A4 size and print the document image. The process of the MFP 1 proceeds to Act 25. In Act 25, the processor 51 calculates an enlargement magnification ratio Y% for returning the document image to the A4 size. When the enlargement magnification ratio Y% is calculated, the process of the MFP 1 proceeds to Act 26.

In Act 26, the processor 51 outputs the enlargement magnification ratio Y% to the print processing unit 42. The print processing unit 42 sets the enlargement magnification ratio Y% to the enlargement processing unit 43. When the enlargement magnification ratio Y% is set to the enlargement processing unit 43, the process of the MFP 1 proceeds to Act 23 above.

Hereinafter, the scan operation of the copy operation in a case where the printing sheet is the A3 size will be described with reference to FIG. 4 above.

As described above, in Act 1 to Act 3, the width size detecting unit 12 detects the width-direction length of the document sheets set in the document tray of the ADF 100. The processor estimates that the maximum size of the document sheets set in the document tray is the A3 size.

Furthermore, the processor 51 recognizes that the mixed mode is input by the user as the process mode of the MFP 1 and that the A3 size is input as the size of the printing sheet. When the processor 51 recognizes the size of the printing sheet, the process of the MFP 1 proceeds to Act 4 above.

In Act 4 above, the processor 51 determines that it is necessary to perform the equal magnification process on the document image based on the estimation result of the maximum size (the A3 size) of the document sheet and the recognition result of the process mode (the mixed mode) and the printing sheet size (the A3 size). The process of the MFP 1 in which the processor 51 determines that it is necessary to perform the equal magnification process on the document image proceeds to Act 12 above.

In Act 12 above, the first scanner processing unit 22 and the second scanner processing unit 32 set the magnification ratio 100% to the first reduction processing unit 23 and the second reduction processing unit 33. When the magnification ratio 100% is set to the first reduction processing unit 23 and the second reduction processing unit 33, the process of the MFP 1 proceeds to Act 7 above.

In Act 7 to Act 11 above, when the processor 51 receives a copy start instruction of a user, the first scanner 2 reads the document image on the first side of the document sheet at the set magnification ratio 100%. The processor 51 stores the read document image data of the first side in the storage unit 7. The document size detecting unit 6 detects the size of the document sheet based on the reading result of the first side. The processor 51 stores the detected size of the document sheet in the storage unit 7.

Furthermore, the second scanner 3 reads the document image on the second side of the document sheet at the set magnification ratio 100%. The processor 51 stores the read document image data of the second side in the storage unit 7. As described above, the detection of the document size based on the reading result of the second side is not performed.

As described above, the processor 51 repeats the processes from Act 7 to Act 10 above until all the documents set in the document tray are scanned. When the processor 51 determines that all the documents set in the document tray are scanned, the scan operation of the MFP 1 ends.

Hereinafter, the printing operation of the copy operation in a case where the size of the printing sheet is the A3 size will be described with reference to FIG. 5 above.

In Act 21 above, as described above, the processor 51 acquires the size of the printed image based on the size information of the document sheet stored in the storage unit 7. When the size of the document sheet stored in the storage unit 7 is the A3 size, the document image stored in the storage unit 7 is also the image with A3 size. Accordingly, it is not necessary to perform the magnification process on the document image to be printed on the printing sheet with A3 size. Therefore, the processor 51 determines that it is necessary to print the document image by the equal magnification process. In Act above, the processor 51 outputs the enlargement magnification ratio 100% to the print processing unit 42 to perform the printing by the equal magnification process, and the print processing unit 42 sets the enlargement magnification ratio 100% to the enlargement processing unit 43. In Act 23 above, the print engine 41 prints the document image based on the document image data processed at the magnification ratio 100% by the print processing unit 42.

In contrast, when the size of the document sheet stored in the storage unit 7 is the A4 size, the document image stored in the storage unit 7 is also the image with A4 size. Accordingly, it is necessary to enlarge the document image to a size (A3 size) suitable to be printed on the printing sheet with A3 size. In Act 25 above, the processor 51 calculates an enlargement magnification ratio Z% for enlarging the document image with A4 size to the image with A3 size. In Act 26 above, the print processing unit 42 sets the enlargement magnification ratio Z% to the enlargement processing unit 43, and in Act 23 above, the print engine 41 prints the document image based on the document image processed at the enlargement magnification ratio Z%.

As described above, according to the image forming apparatus of the embodiment, only by providing the scanner with the reduction processing function and providing the printer with the enlargement processing function, it is possible to perform copying in the mixed mode without lowering the process speed.

In addition, in the embodiment described above, the case where the sizes of the document sheets are the A4 size and the A3 size and the case where the sizes of the printing sheets are the A4 size and the A3 size have been described by way of example, but the sizes of the document sheets and the sizes of the printing sheets are not limited thereto.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a scanner configured to:

scan, at a predetermined magnification ratio, a plurality of document sheets with different sizes to generate a plurality of document images that correspond, respectively, to the plurality of document sheets, and output the generated document images;

an automatic document feeder configured to transport the plurality of document sheets with different sizes to the scanner;

a width detecting unit configured to detect a width of the document sheets in a direction orthogonal to a transport direction of the document sheets transported by the automatic document feeder;

an input unit configured to accept an input selecting a predetermined size of printing sheets;

a printer configured to print the output document images, at one of an enlarged printing ratio and an equal-magnification printing ratio, onto the printing sheets having the selected predetermined size; and a controller configured to:

before the scanner scans the document sheets, estimate a maximum size of the document sheets to be scanned by the scanner based on a detection result of the width detecting unit, calculate an image reduction ratio by comparing the estimated maximum size of the document sheets to the selected predetermined size of the printing sheets, and set the predetermined magnification ratio to be the image reduction ratio at which the scanner scans each of the document sheets when the estimated maximum size of the document sheets is larger than the selected predetermined size of the printing sheets.

2. The image forming apparatus according to claim 1, wherein the controller determines an actual size of each of the document sheets after the scanner scans the document sheets.

3. The image forming apparatus according to claim 2, wherein the controller is further configured to determine whether the printer prints the document image using an equal magnification process or prints the document image using an enlargement process, based on the determined actual size of the document sheets and the selected predetermined size of the printing sheets.

4. The image forming apparatus according to claim 1, wherein the input unit is a display.

5. An image forming apparatus comprising:

a scanner configured to:

scan, at a predetermined magnification ratio, a plurality of document sheets with different sizes to generate a plurality of document images that correspond, respectively, to the plurality of document sheets, and output the generated document images;

an automatic document feeder configured to transport the plurality of document sheets with different sizes to the scanner;

a width detecting unit configured to detect a width of the document sheets in a direction orthogonal to a transport direction of the document sheets transported by the automatic document feeder;

an input unit configured to accept an input selecting a predetermined size of printing sheets;

a printer configured to print the output document images, at one of an enlarged printing ratio and an equal-magnification printing ratio, onto the printing sheets having the selected predetermined size; and a controller configured to:

before the scanner scans the document sheets, estimate a maximum size of the document sheets to be scanned by the scanner based on a detection result of the width detecting unit, calculate an image reduction ratio by comparing the estimated maximum size of the document sheets to the selected predetermined size of the printing sheets, and set the predetermined magnification ratio to be:

an equal magnification ratio at which the scanner scans each of the document sheets when the estimated maximum size of the document sheets is the same as the selected predetermined size of the printing sheets, or the image reduction ratio at which the scanner scans each of the document sheets when the estimated maximum size of the document sheets is larger than the selected predetermined size of the printing sheets.

6. The image forming apparatus according to claim 5, wherein the controller determines an actual size of each of the document sheets after the scanner scans the document sheets.

7. The image forming apparatus according to claim 6, wherein the controller is further configured to determine whether the printer prints the document image using an equal magnification process or prints the document image using an enlargement process, based on the determined size of the document sheets and the predetermined size of the printing sheets.

8. The image forming apparatus according to claim 5, wherein the input unit is a display.

9. An image forming apparatus comprising:

a scanner configured to:

scan, at a predetermined magnification ratio, a plurality of document sheets with different sizes to generate a plurality of document images that correspond, respectively, to the plurality of document sheets output the generated document images;

an automatic document feeder configured to transport the plurality of document sheets with different sizes to the scanner;

a width detecting unit configured to detect a width of the document sheets in a direction orthogonal to a transport direction of the document sheets transported by the automatic document feeder;

an input unit configured to accept an input selecting a predetermined size of printing sheets;

a printer configured to print the output document images, at one of an enlarged printing ratio and an equal-magnification printing ratio, onto the printing sheets having the selected predetermined size; and a controller configured to:

before the scanner scans the document sheets, estimate a maximum size of the document sheets to be scanned by the scanner based on a detection result of the width detecting unit, calculate an image reduction ratio by comparing the estimated maximum size of the document sheets to the selected predetermined size of the printing sheets, and set the predetermined magnification ratio at which the scanner scans each of the document sheets to be one of the image reduction ratio and an equal magnification ratio based on the estimated maximum size of the document sheets compared to the selected predetermined size of the printing sheet.

10. The image forming apparatus according to claim 9, wherein the controller sets the predetermined magnification ratio at which the scanner scans each of the document sheets to be the image reduction ratio when the estimated maximum size of the document sheets is larger than the selected predetermined size of the printing sheet, and sets the predetermined magnification ratio at which the scanner scans each of the document sheets to be the equal magnification ratio when the estimated maximum size of the document sheets is the same as the selected predetermined size of the printing sheets.

11. The image forming apparatus according to claim 9, wherein the controller determines an actual size of each of the document sheets after the scanner scans the document sheets.

12. The image forming apparatus according to claim 9, wherein the input unit is a display.

* * * * *